US010281839B2

(12) United States Patent
Tanaka et al.

(10) Patent No.: US 10,281,839 B2
(45) Date of Patent: May 7, 2019

(54) IMAGE FORMING APPARATUS AND DEVELOPER SUPPLY DEVICE WITH FIRST AND SECOND TRANSPORT MEMBERS CONFIGURED TO TRANSPORT DEVELOPER AT DIFFERENT SPEEDS

(71) Applicant: FUJI XEROX CO., LTD., Tokyo (JP)

(72) Inventors: Yoshinori Tanaka, Kanagawa (JP); Atsushi Funada, Kanagawa (JP); Hideki Kuge, Kanagawa (JP); Seigo Shinozaki, Kanagawa (JP); Takayuki Yamada, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 11 days.

(21) Appl. No.: 15/715,243

(22) Filed: Sep. 26, 2017

(65) Prior Publication Data

US 2018/0253027 A1 Sep. 6, 2018

(30) Foreign Application Priority Data

Mar. 6, 2017 (JP) ..... 2017-041212

(51) Int. Cl.

| | |
|---|---|
| ***G03G 15/08*** | (2006.01) |
| ***G03G 15/00*** | (2006.01) |
| ***G03G 21/16*** | (2006.01) |

(52) U.S. Cl.

CPC ..... *G03G 15/0856* (2013.01); *G03G 15/0891* (2013.01); *G03G 15/0893* (2013.01); *G03G 15/0822* (2013.01); *G03G 15/0865* (2013.01); *G03G 15/0877* (2013.01); *G03G 15/0887* (2013.01); *G03G 15/0889* (2013.01); *G03G 15/0896* (2013.01); *G03G 15/556* (2013.01); *G03G 21/1676* (2013.01)

(58) Field of Classification Search

None

See application file for complete search history.

(56) References Cited

U.S. PATENT DOCUMENTS

| | | | | |
|---|---|---|---|---|
| 4,937,625 | A * | 6/1990 | Kato | G03G 15/0877 399/258 |
| 2006/0115302 | A1* | 6/2006 | Hosokawa | G03G 15/0822 399/254 |

(Continued)

FOREIGN PATENT DOCUMENTS

| | | | | |
|---|---|---|---|---|
| JP | 59100472 | A * | 6/1984 | G03G 15/0822 |
| JP | 2011197324 | A * | 10/2011 | G03G 15/0875 |
| JP | 2015-184310 | A | 10/2015 | |

*Primary Examiner* — Joseph S Wong

(74) *Attorney, Agent, or Firm* — Sughrue Mion, PLLC

(57) ABSTRACT

A developer supply device includes a container body that receives and contains a developer with which a toner cartridge is filled and that has a supply port used for supplying the developer, which is contained in the container body, to a developing device, a sensing member that detects the developer contained in the container body, a first transport member that is rotatably disposed in the container body and that transports the developer at a first transport speed by rotating, and a second transport member that is rotatably disposed in the container body in such a manner as to face the sensing member and that transports the developer at a second transport speed that is higher than the first transport speed by rotating.

11 Claims, 7 Drawing Sheets

(56) References Cited

U.S. PATENT DOCUMENTS

| | | | | |
|---|---|---|---|---|
| 2008/0260430 | A1* | 10/2008 | Sakamoto | G03G 15/0822 399/254 |
| 2010/0310275 | A1* | 12/2010 | Hirota | G03G 15/0893 399/254 |
| 2013/0058670 | A1* | 3/2013 | Nakatake | G03G 15/0862 399/53 |
| 2015/0098827 | A1* | 4/2015 | Reidhaar | F16D 1/108 416/176 |
| 2015/0125185 | A1* | 5/2015 | Furukawa | G03G 15/0893 399/254 |
| 2015/0268585 | A1 | 9/2015 | Kadowaki | |

* cited by examiner

IMAGE FORMING APPARATUS AND DEVELOPER SUPPLY DEVICE WITH FIRST AND SECOND TRANSPORT MEMBERS CONFIGURED TO TRANSPORT DEVELOPER AT DIFFERENT SPEEDS

CROSS-REFERENCE TO RELATED APPLICATIONS

This application is based on and claims priority under 35 USC 119 from Japanese Patent Application No. 2017-041212 filed Mar. 6, 2017.

BACKGROUND

The present invention relates to a developer supply device and an image forming apparatus.

SUMMARY

According to an aspect of the invention, there is provided a developer supply device including a container body that receives and contains a developer with which a toner cartridge is filled and that has a supply port used for supplying the developer, which is contained in the container body, to a developing device, a sensing member that detects the developer contained in the container body, a first transport member that is rotatably disposed in the container body and that transports the developer at a first transport speed by rotating, and a second transport member that is rotatably disposed in the container body in such a manner as to face the sensing member and that transports the developer at a second transport speed that is higher than the first transport speed by rotating.

BRIEF DESCRIPTION OF THE DRAWINGS

An exemplary embodiment of the present invention will be described in detail based on the following figures, wherein.

DETAILED DESCRIPTION

Figure 1:
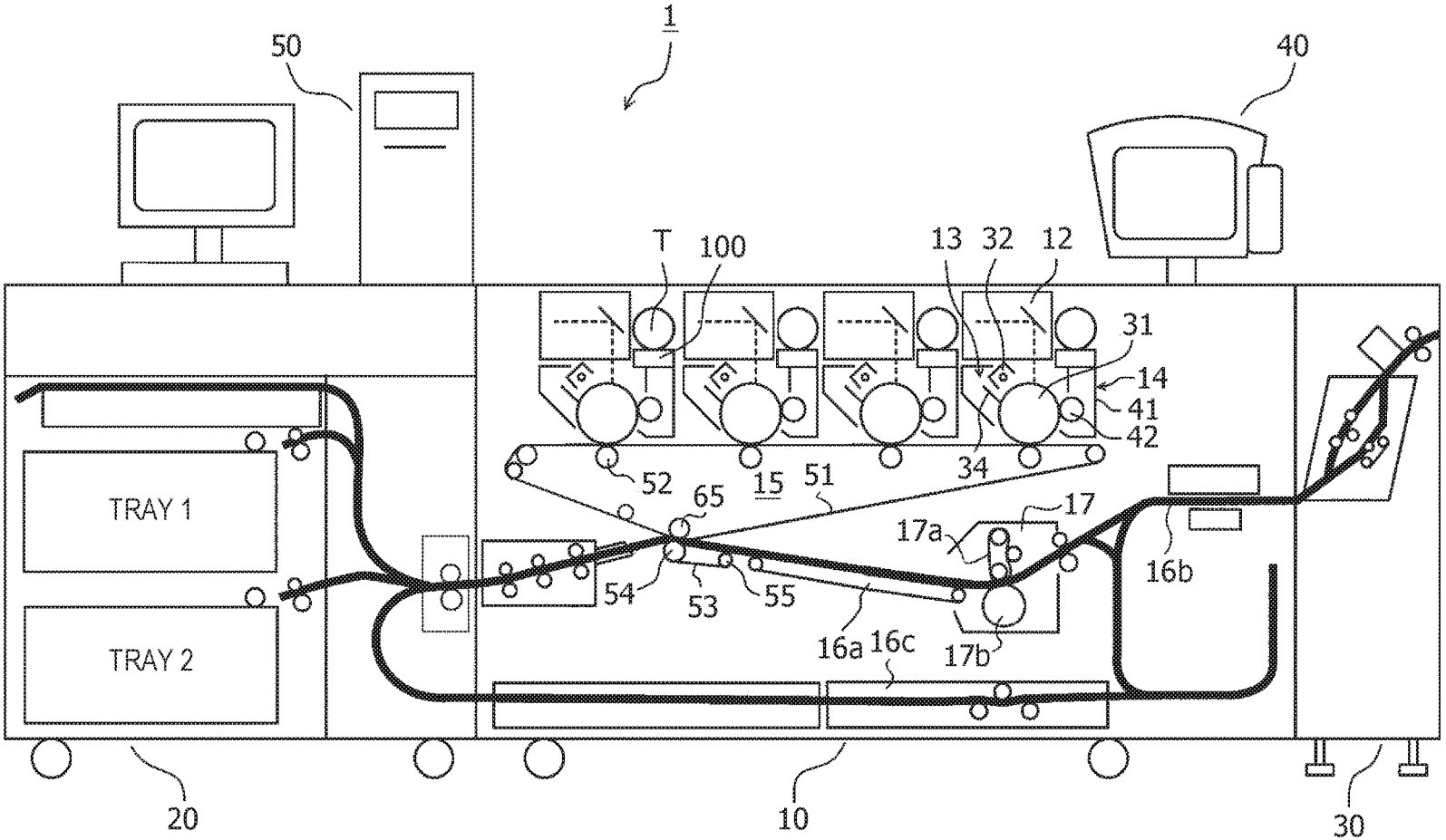
FIG. 1 is a schematic sectional view illustrating a schematic configuration example of an image forming apparatus.

Although an exemplary embodiment of the present invention will be described in detail below using a specific example and with reference to the drawings, the present invention is not limited to the following exemplary embodiment and specific example.

In the drawings that will be referred to in the following description, objects are schematically illustrated, and it should be noted that dimensional ratios and so forth of the objects that are illustrated in the drawings are different from those of actual objects. In addition, in the drawings, illustration of components that are not necessary for the following description is suitably omitted for ease of understanding.

For ease of understanding of the following description, in the drawings, a front-rear direction, a left-right direction, and a top-bottom direction are respectively defined as the X-axis direction, the Y-axis direction, and the Z-axis direction.

(1) Overall Configuration and Operation of Image Forming Apparatus (1.1) Overall Configuration of Image Forming Apparatus FIG. 1 is a schematic sectional view illustrating a schematic configuration example of an image forming apparatus 1 according to an exemplary embodiment of the present invention.

The image forming apparatus 1 includes an image forming unit 10, a sheet feeding device 20 that is mounted on a first end of the image forming unit 10, a sheet-ejection unit 30 that is mounted on a second end of the image forming unit 10 and to which a printed sheet is to be ejected, an operation-display unit 40, and an image processing unit 50 that generates image information from print information transmitted from a host device.

The image forming unit 10 includes a system control unit 11 (not illustrated), exposure devices 12, photoconductor units 13, developing devices 14, a transfer device 15, sheet transport devices 16*a*, 16*b*, and 16*c*, a fixing device 17, and a driving device 18 (not illustrated) and forms a toner image on one of sheets P, which is sent from the sheet feeding device 20, by using image information received from the image processing unit 50.

The sheet feeding device 20 feeds a sheet to the image forming unit 10. In other words, the sheet feeding device 20 includes plural sheet-stacking units in which the sheets P having different properties (e.g., material, thickness, sheet size, and grain) are accommodated and is configured to feed one of the sheets P that is sent out from one of the plural sheet-stacking units to the image forming unit 10.

The sheet-ejection unit 30 ejects one of the sheets P to which an image has been output by the image forming unit 10. Accordingly, the sheet-ejection unit 30 includes an ejected-sheet-accommodating unit to which the sheet P to which the image has been output is ejected. Note that the sheet-ejection unit 30 may have a function of performing post-processing, such as cutting or stapling, on a stack of sheets output by the image forming unit 10.

The operation-display unit 40 is used for performing various settings, inputting instructions, and displaying information. In other words, the operation-display unit 40 corresponds to a so-called user interface, and more specifically, the operation-display unit 40 is formed by combining a liquid crystal display panel, various operation buttons, a touch panel, and the like.

(1.2) Configuration and Operation of Image Forming Unit

In the image forming apparatus 1, which has the above-described configuration, the sheets P each of which is specified to be subjected to a printing operation by a print job are sent out from the sheet-stacking units of the sheet feeding device 20 to the image forming unit 10 in accordance with the timing at which image formation is performed.

The photoconductor units 13 are arranged side by side in such a manner that each of the photoconductor units 13 is located below a corresponding one of the exposure devices 12. Each of photoconductor units 13 includes a photoconductor drum 31 serving as an image carrier that is driven so as to rotate. Chargers 32, the exposure devices 12, the developing devices 14, first transfer rollers 52, and cleaning blades 33 are arranged in the direction of rotation of the corresponding photoconductor drums 31.

Each of the developing devices 14 includes a developing housing 41 containing a developer G. Developing rollers 42 are each disposed in a corresponding one of the developing housings 41 in such a manner as to face the corresponding photoconductor drum 31, and trimmers 46 (see FIG. 2) that control the layer thickness of the developer G are each disposed close to a corresponding one of the developing rollers 42.

The configurations of the developing devices 14 are substantially similar to one another, except with regard to the developer G contained in the developing housings 41, and each of the developing devices 14 forms one of toner images of yellow (Y), magenta (M), cyan (C), and black (K).

Toner cartridges T and developer supply devices 100 are each disposed above a corresponding one of the developing devices 14. Each of the toner cartridges T contains the developer G (a toner including a carrier) and is replaceable. Each of the developer supply devices 100 supplies the developer G from a corresponding one of the toner cartridges T to the corresponding developing device 14.

Surfaces of the photoconductor drums 31, which rotate, are charged by the corresponding chargers 32, and electrostatic latent images are formed on the surfaces of the photoconductor drums 31 by using latent image-forming light beams emitted from the exposure devices 12. The electrostatic latent images formed on the photoconductor drums 31 are developed into toner images by the corresponding developing rollers 42.

The transfer device 15 includes an intermediate transfer belt 51, the first transfer rollers 52, and a second transfer belt 53. The intermediate transfer belt 51 serves as a member having an endless loop shape onto which toner images of the different colors, which are formed on the photoconductor drums 31 of the photoconductor units 13, are transferred such that the toner images are superposed with one another. The first transfer rollers 52 sequentially transfer (in a first transfer process) toner images of the different colors, which are formed by the photoconductor units 13, onto the intermediate transfer belt 51. The second transfer belt 53 collectively transfers (in a second transfer process) toner images of the different colors that have been transferred to the intermediate transfer belt 51 in such a manner as to be superposed with one another onto a sheet, which is a recording medium.

The second transfer belt 53 is stretched between a second transfer roller 54 and a separation roller 55, a second transfer region TR is formed as a result of the second transfer belt 53 being nipped between a backup roller 65 that is disposed on the rear surface side of the intermediate transfer belt 51 and the second transfer roller 54.

Toner images of the different colors formed on the photoconductor drums 31 of the photoconductor units 13 are sequentially and electrostatically transferred (in the first transfer process) onto the intermediate transfer belt 51 by the first transfer rollers 52 to each of which a predetermined transfer voltage has been applied by a power supply unit or the like (not illustrated) controlled by the system control unit 11, and as a result, a superposed toner image, which is formed of the toner images of the different colors superposed with one another, is formed.

The superposed toner image on the intermediate transfer belt 51 is transported to the second transfer region TR, in which the second transfer belt 53 is disposed, along with movement of the intermediate transfer belt 51. One of the sheets P is supplied from the sheet feeding device 20 to the second transfer region TR in accordance with the timing at which the superposed toner image is transported to the second transfer region TR. Then, a predetermined transfer voltage is applied to the backup roller 65, which faces the second transfer roller 54 with the second transfer belt 53 interposed therebetween, by the power supply unit or the like controlled by the system control unit 11, and the superposed toner image on the intermediate transfer belt 51 is collectively transferred onto the sheet P.

The cleaning blades 33 remove toner remaining on the surfaces of the corresponding photoconductor drums 31, and the toner is collected and placed into a waste-toner container (not illustrated). The surfaces of the photoconductor drums 31 are charged again by the corresponding chargers 32.

The fixing device 17 includes an endless fixing belt 17*a* that rotates in one direction and a pressure roller 17*b* that is in contact with the outer surface of the fixing belt 17*a* and that rotates in one direction. A press-contact region between the fixing belt 17*a* and the pressure roller 17*b* forms a nip part (fixing region).

One of the sheets P to which toner images have been transferred by the transfer device 15 is transported to the fixing device 17 via the sheet transport device 16*a* in a state where the toner images are unfixed to the sheet P. The toner images are fixed onto the sheet P, which is transported to the fixing device 17, as a result of pressure and heat being applied to the sheet P by the fixing belt 17*a* and the pressure roller 17*b*, which are paired with each other.

The sheet P to which the toner images have been fixed is sent into the sheet-ejection unit 30 via the sheet transport device 16*b*.

Note that, in the case of performing image output on the two surfaces of one of the sheets P, the sheet P is flipped over by the sheet transport device 16*c*, and the sheet P is sent again into the second transfer region TR in the image forming unit 10. After transfer of toner images and fixation of transferred toner images have been performed, the sheet P is sent into the sheet-ejection unit 30. The sheet P that is sent into the sheet-ejection unit 30 undergoes post-processing, such as cutting or stapling, as necessary and is then ejected to the ejected-sheet-accommodating unit.

(2) Configuration and Operation of Principal Portion

Figure 2:
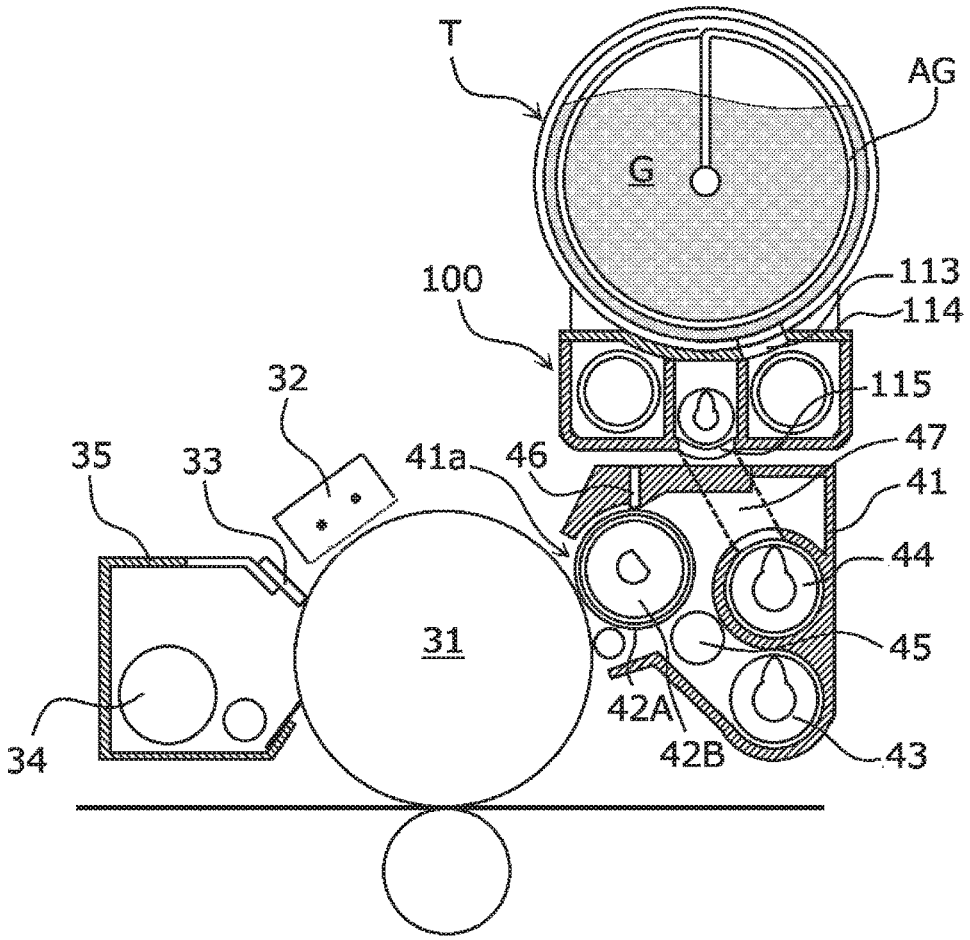
FIG. 2 is a longitudinal schematic sectional view illustrating a photoconductor unit, a developing device, and a developer supply device.
Figure 3:
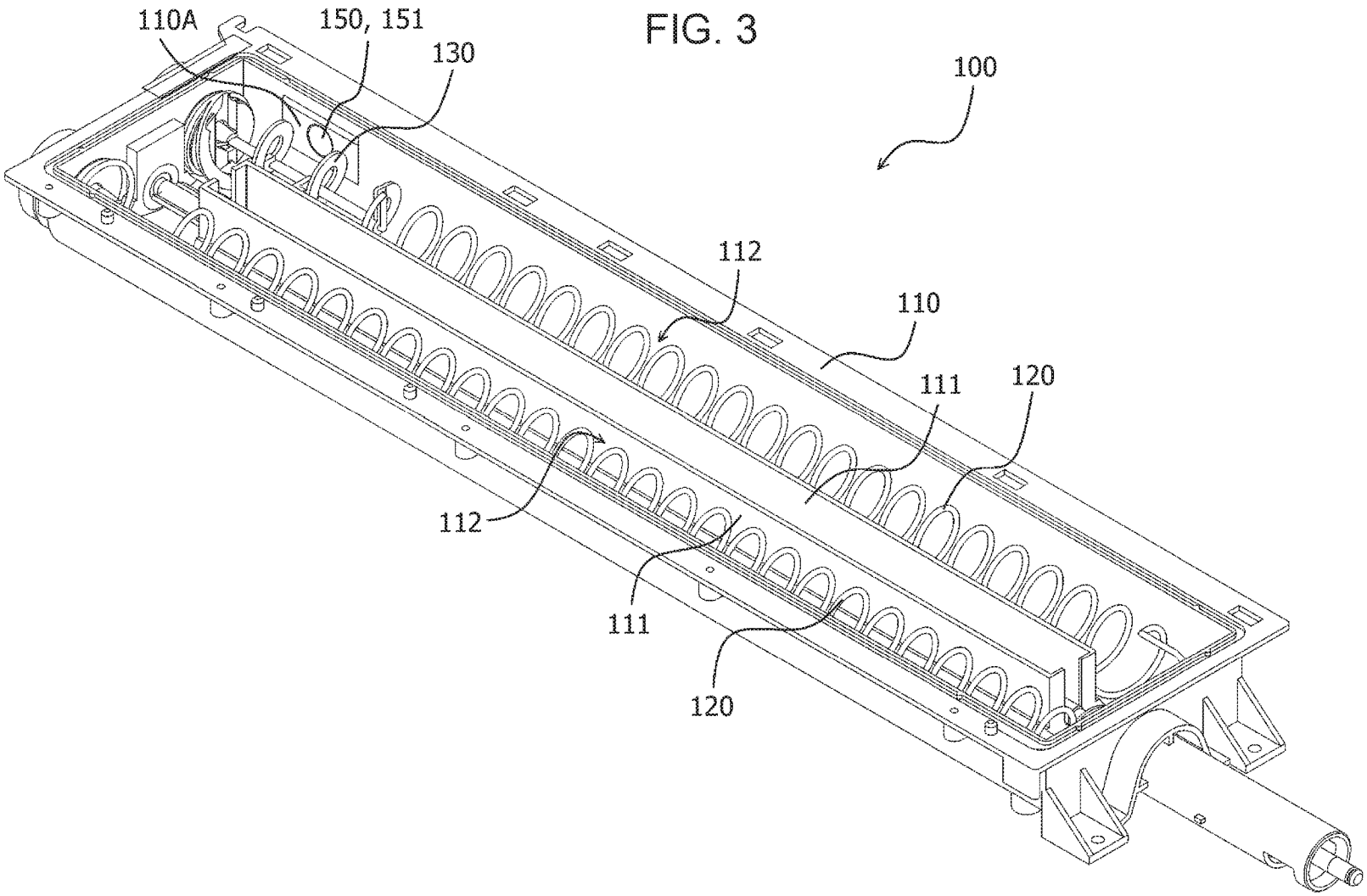
FIG. 3 is a perspective view illustrating an internal configuration of the developer supply device.
Figure 4:
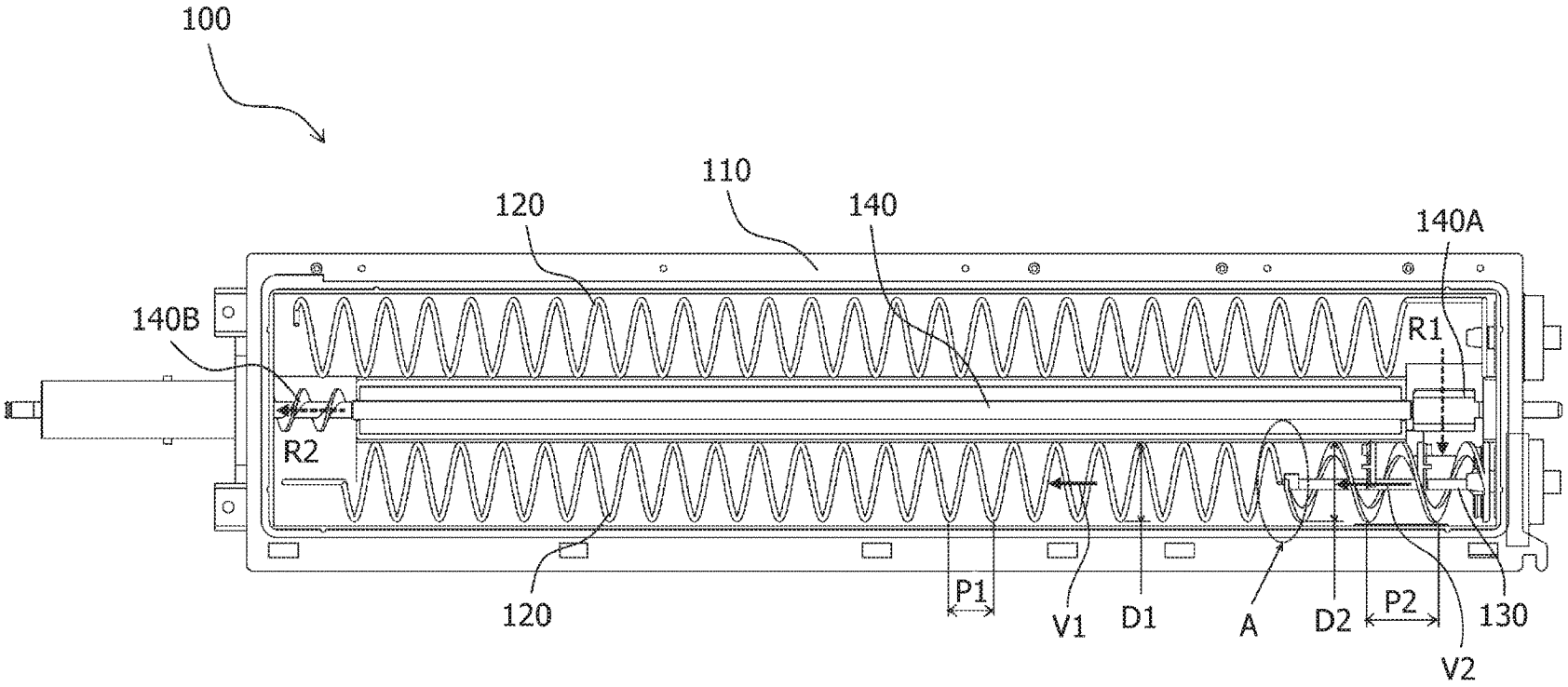
FIG. 4 is a plan view illustrating an internal configuration of the developer supply device.
Figure 5:
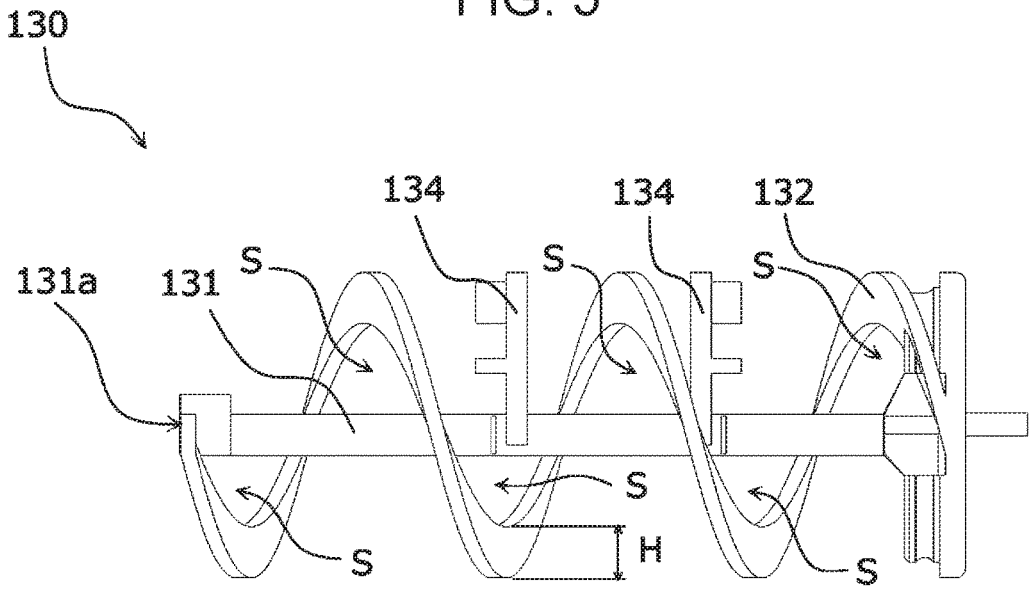
FIG. 5 is a front view illustrating a second transport auger.
Figure 6:
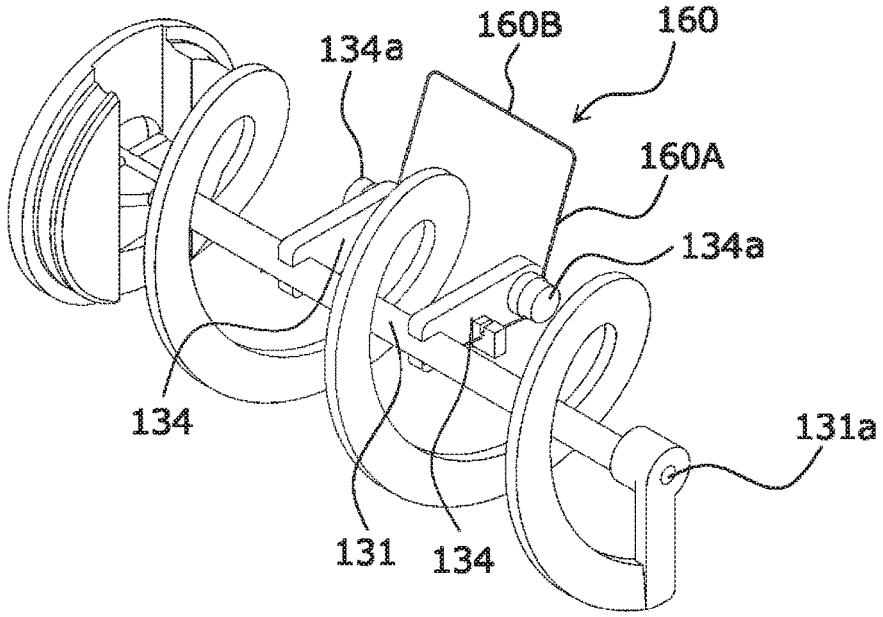
FIG. 6 is a perspective view illustrating the second transport auger provided with a cleaning wire.

FIG. 2 is a longitudinal schematic sectional view illustrating one of the photoconductor units 13, the corresponding developing device 14, and the corresponding developer supply device 100. FIG. 3 is a perspective view illustrating the internal configuration of one of the developer supply devices 100. FIG. 4 is a plan view illustrating the internal configuration of one of the developer supply devices 100. FIG. 5 is a front view illustrating a second transport auger 130. FIG. 6 is a perspective view illustrating the second transport auger 130 provided with a cleaning wire 160.

The configuration and operation of each of the developer supply devices 100 will now be described below with reference to the drawings.

(2.1) Photoconductor Unit

As illustrated in FIG. 2, in the photoconductor unit 13, the photoconductor drum 31 is rotatably supported on a unit housing 35, and the charger 32, the cleaning blade 33, and a transport auger 34 are disposed in the unit housing 35. The transport auger 34 transports toner removed by the cleaning blade 33 to a waste-toner collecting container (not illustrated).

(2.2) Developing Device

In the developing device 14, the developing roller 42 is rotatably supported on the developing housing 41. The developing roller 42 is disposed in such a manner as to face the outer peripheral surface of the photoconductor drum 31 through an opening 41*a* that is formed in the developing housing 41. The developing roller 42 includes a developing sleeve 42A having a cylindrical shape and a magnet 42B that is a magnet member having a columnar shape. The developing sleeve 42A is rotatably supported on the developing housing 41, and the magnet 42B is disposed in the internal space of the developing sleeve 42A and fixed to the developing housing 41.

A stirring auger 43, a supply auger 44, an accumulated-developer transport auger 45, and one of the trimmers 46 are disposed in the developing housing 41. The developing housing 41 is filled with the developer G supplied by the corresponding developer supply device 100, which will be described later, and the developer G is supplied to the developing roller 42 by the supply auger 44. The layer thickness of the developer G supplied to the developing roller 42 is controlled by the trimmer 46, and the developer G is held in the form of a magnetic brush on the outer peripheral surface of the developing sleeve 42A by using the magnetic force of the magnet 42B. As a result of rotation of the developing sleeve 42A, the developer G is transported and supplied to an electrostatic latent image on the photoconductor drum 31.

A passage hole 47 is formed on one end side of an upper portion of the developing housing 41 (the front side of the image forming apparatus 1), and the developer G supplied from the developer supply device 100 passes through the passage hole 47. The developing housing 41 receives the developer G from an ejection port 115 of the developer supply device 100, which will be described below.

(2.3) Developer Supply Device (2.3.1) Overall Configuration of Developer Supply Device As illustrated in FIG. 3, each of the developer supply devices 100 includes a container body 110 that receives and contains the developer G with which the corresponding toner cartridge T is filled, first transport augers 120 each serving as a first transport member that is rotatably disposed in the container body 110 and that transports the developer G by rotating, the second transport auger 130 serving as a second transport member, and a developer sensor 150 serving as a sensing member that detects the developer G contained in the container body 110.

(2.3.2) Container

As illustrated in FIG. 3 and FIG. 4, a partition wall 111 is vertically formed at a center portion of the container body 110, which has the shape of a box, and a circulation path 112 is formed in the container body 110. The first transport augers 120 and the second transport auger 130 are rotatably accommodated in the circulation path 112 so as to cause the developer G to circulate.

The container body 110 is covered with a cover member 114 (see FIG. 2) having a replenishment port 113, which is formed at an end of the cover member 114 and which receives the developer G ejected from the corresponding toner cartridge T, and contains the developer G therein. The ejection port 115 (see FIG. 2) is formed at an end of the container body 110 and connected to the passage hole 47 of the corresponding developing device 14 so as to supply the developer G, which is contained in the container body 110, to the developing device 14.

The developer sensor 150 is capable of being mounted onto a side wall 110A located below the replenishment port 113 of the container body 110 from outside the container body 110 such that the interior of the container body 110 is exposed to a sensing surface 151 of the developer sensor 150.

The developer sensor 150 is a pressure-sensitive sensor that detects the amount of the developer G contained in the container body 110 by using the pressure from the developer G.

Note that the developer sensor 150 may be disposed without being exposed at the side wall 110A of the container body 110 by using an inductance sensor having a high sensitivity as the developer sensor 150.

(2.3.3) Transport Auger

The first transport augers 120 and the second transport auger 130 each of which is formed in a helical or substantially helical manner are arranged in the horizontal direction in the circulation path 112 of the container body 110 so as to be rotatable about a rotation axis in the direction in which the rotation axis extends. In addition, an auxiliary transport auger 140 is disposed in a region inside the partition wall 111 so as to be positioned between the first transport augers 120 and the second transport auger 130 when viewed in plan view and so as to be rotatable about a rotation axis in the direction in which the rotation axis extends. The auxiliary transport auger 140 includes a paddle 140A disposed at a first end thereof and a helical or substantially helical blade 140B disposed at a second end thereof. The paddle 140A delivers the developer G from one of the two first transport augers 120 to the other of the two first transport augers 120 (see arrow R1 in FIG. 4), and the helical or substantially helical blade 140B sends the developer G, which circulates, into the ejection port 115 (see arrow R2 in FIG. 4).

Each of the first transport augers 120 is a coil auger that includes a metal wire rod wound in a helical or substantially helical manner at a first helical pitch P1 that is smaller than that of the second transport auger 130, and a transport speed V1 at which each of the first transport augers 120 transports the developer G is set to be lower than a transport speed V2 at which the second transport auger 130 transports the developer G. Consequently, the developer G is temporarily stored in the container body 110 while being stirred, so that the container body 110 has a function of serving as a reserve tank for the developer G, which is supplied to the developing devices 14. As a result, especially in a high-speed image forming apparatus, replacement of a toner cartridge may be performed in a state where the image forming apparatus is in an operational state without stopping the image forming apparatus when a printing operation is continuously performed.

The second transport auger 130 is an auger that is made of a resin and that includes a helical or substantially helical blade 132 arranged along the outer periphery of a shaft 131 at a second helical pitch P2 that is longer than the first helical pitch P1 of each of the first transport augers 120. The blade height H of the blade 132 in a direction crossing the shaft 131 is set to be larger than the wire diameter of the metal wire rod of each of the first transport augers 120. Consequently, the transport speed V2 at which the second transport auger 130 transports the developer G is higher than the transport speed V1 at which each of the first transport augers 120 transports the developer G.

As illustrated in FIG. 5, in the second transport auger 130, the helical or substantially helical blade 132 is formed in such a manner that a predetermined space S is formed between the second transport auger 130 and the shaft 131. As a result, the developer G that is transported by the second transport auger 130 in the circulation path 112 is capable of passing through the space S, and an increase in the rotation torque of the second transport auger 130 may be suppressed.

An opening 131*a* (see FIG. 6) is formed at an end of the shaft 131, and an end portion of the metal wire rod of one of the first transport augers 120 is fitted into the opening 131*a*. As a result of the second transport auger 130 being driven by a driving source (not illustrated) so as to rotate, the first transport auger 120 is driven so as to integrally rotate with the second transport auger 130.

As illustrated in FIG. 4, the first transport augers 120 and the second transport auger 130 are formed in such a manner that an outer diameter D1 of each of the first transport augers 120 is approximately equal to an outer diameter D2 of the second transport auger 130, and the phase of the helical structure of one of the first transport augers 120 and the phase of the helical structure of the second transport auger 130 substantially match each other at a connecting portion in which the first transport auger 120 and the second transport auger 130 are connected to each other (see the connecting portion indicated by the reference character A in FIG. 4).

(2.3.4) Cleaning Wire

As illustrated in FIG. 6, the cleaning wire 160 that is formed by bending an elastic wire capable of elastically deforming is disposed on an end portion of the shaft 131 of the second transport auger 130 that faces the developer sensor 150. The cleaning wire 160 is an example of a cleaning member that cleans the sensing surface 151 of the developer sensor 150 to which the interior of the container body 110 is exposed.

More specifically, the cleaning wire 160 includes a pair of support portions 160A and a cleaning portion 160B that extends between the tip ends of the pair of support portions 160A and that cleans sensing surface 151 (see FIG. 3). The base ends of the support portions 160A are attached to end portions 134*a* of a pair of attachment portions 134 each of which extends from the shaft 131 of the second transport auger 130 in a radial direction of the shaft 131, and the tip ends of the support portions 160A extend in a direction perpendicular to the attachment portions 134 when viewed in the direction in which the shaft 131 extends. As described above, since the second transport auger 130 is formed by using a synthetic resin, each of the attachment portions 134 may be formed into a shape that improves the efficiency of the operation of attaching the cleaning wire 160.

When the second transport auger 130 is caused to rotate in a state where the cleaning wire 160 is attached to the shaft 131 of the second transport auger 130, the cleaning wire 160 rotates about the shaft 131. The cleaning portion 160B of the cleaning wire 160, which rotates about the shaft 131, comes into contact with the inner surface of the side wall 110A of the container body 110.

As a result of the cleaning portion 160B coming into contact with the inner surface of the side wall 110A, each of the support portions 160A is elastically deformed into an arch shape, and the cleaning portion 160B passes across the sensing surface 151 from a first end of the sensing surface 151 to a second end of the sensing surface 151 while being in contact with the inner surface of the side wall 110A and the sensing surface 151, so that the sensing surface 151 of the developer sensor 150 with the developer G adhered thereto is cleaned.

(3) Operation of Developer Supply Device

Figure 7:
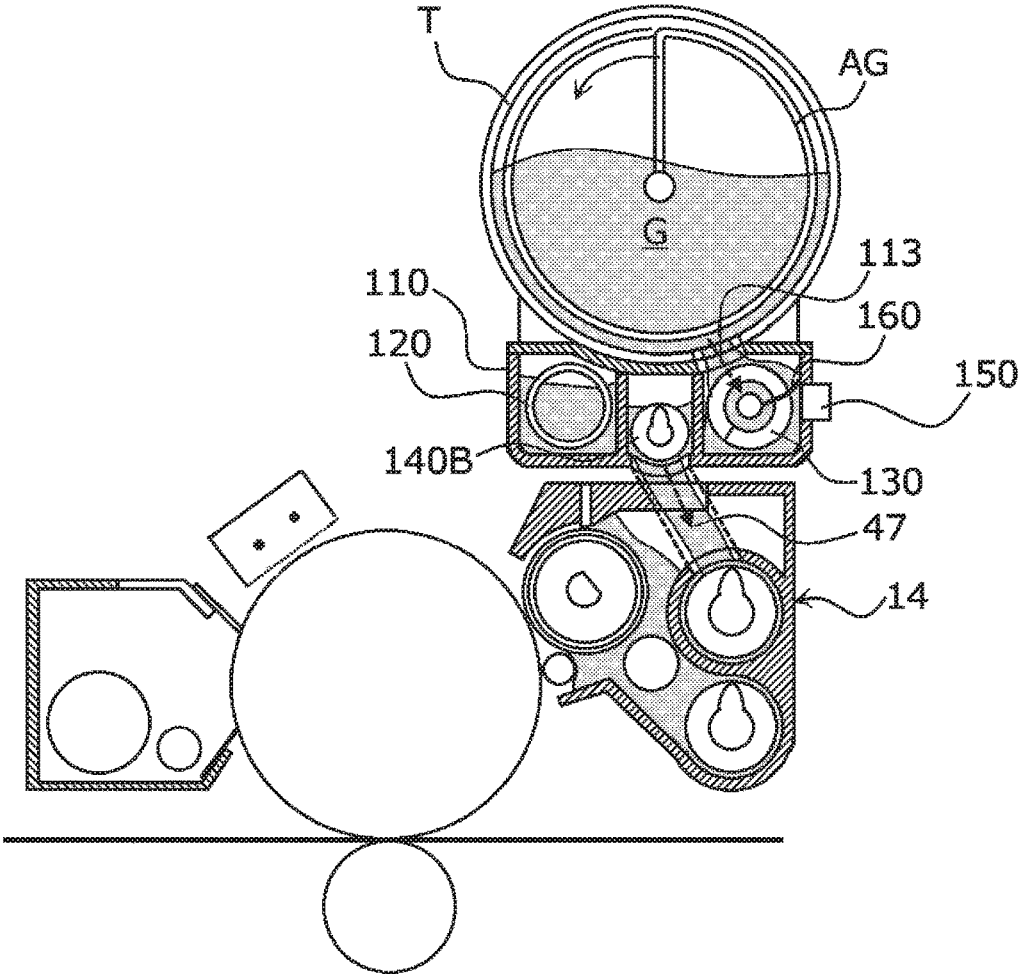
FIG. 7 is a longitudinal schematic sectional view illustrating the flow of a developer in the developing device and the flow of the developer in the developer supply device.
Figure 8:
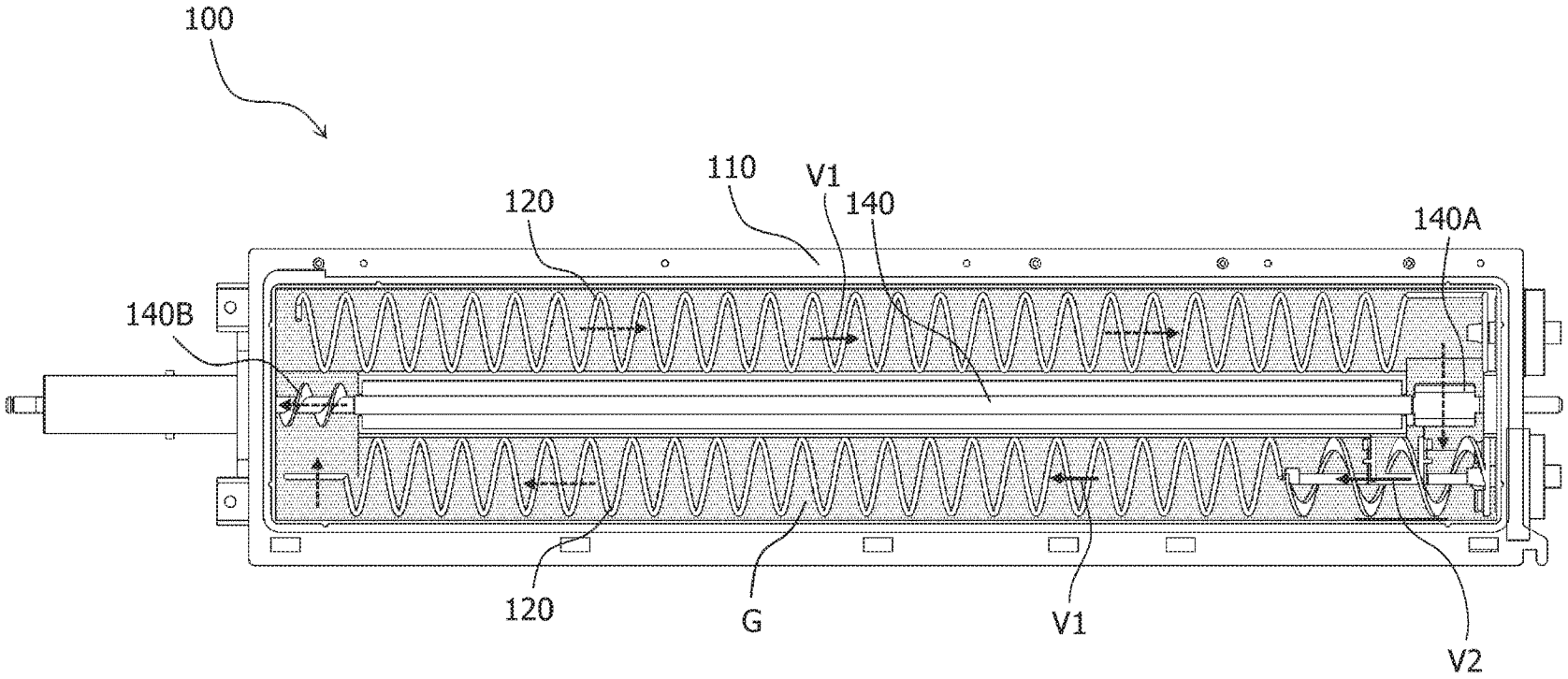
FIG. 8 is a schematic plan view illustrating transportation of the developer in the developer supply device.

FIG. 7 is a longitudinal schematic sectional view illustrating the flow of the developer G in one of the developing devices 14 and the flow of the developer G in the corresponding developer supply device 100. FIG. 8 is a schematic plan view illustrating transportation of the developer G in the developer supply device 100. Operation of the developer supply device 100 will be described below with reference to FIG. 7 and FIG. 8.

As illustrated in FIG. 7, when the developer G in the developing device 14 is used, the system control unit 11 causes, on the basis of the amount of the developer G that has been used, an agitator AG disposed in the corresponding toner cartridge T to rotate so as to supply the developer G with which the toner cartridge T has been filled to the container body 110 of the developer supply device 100 via the replenishment port 113. As a result, an amount of the developer G equal to the amount of the developer G that has been used for forming a toner image is supplied to the container body 110.

Similarly, the system control unit 11 causes, on the basis of the amount of the developer G that has been used, the driving source (not illustrated) to rotate in such a manner as to supply the developer G to the developing device 14 via the ejection port 115 and the passage hole 47 of the developing device 14 while circulating the developer G in the circulation path 112 of the container body 110. As a result, an amount of the developer G equal to the amount of the developer G that has been used for forming a toner image is supplied to the developing device 14.

The developer sensor 150 detects the amount of the developer G contained in the container body 110. When detection results obtained by the developer sensor 150 shows that the amount of the developer G that has been supplied to the container body 110 is insufficient with respect to the amount of the developer G that has been supplied to the developing device 14 from the container body 110, the system control unit 11 causes the agitator AG, which is provided in the toner cartridge T, to rotate. As a result, an additional amount of the developer G is supplied to the container body 110 from the toner cartridge T so as to compensate for the shortage of the developer G.

As illustrated in FIG. 8, in the container body 110, the developer G supplied to the container body 110 is stored while being transported by the first transport augers 120 and the second transport auger 130 that are driven by the driving source (not illustrated), which is controlled by the system control unit 11, so as to rotate.

Since the transport speed V1 at which each of the first transport augers 120 transports the developer G is set to be lower than the transport speed V2 at which the second transport auger 130 transports the developer G, the developer G may be temporarily stored in the container body 110 while being stirred, and replacement of the toner cartridge T may be performed in a state where the developer supply device 100 is in an operational state without stopping the developer supply device 100 when a printing operation is continuously performed.

Although the exemplary embodiment of the present invention has been described above using a specific example, the technical scope of the present invention is not limited to the above-described exemplary embodiment, and various changes may be made within the scope of the present invention.

For example, the present invention may be applied not only to a developer including a toner and a carrier but also to a developer including a magnetic mono-component toner and a developer including a non-magnetic mono-component toner, and the image forming apparatus may be an image forming apparatus for color printing or an image forming apparatus for monochrome printing.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developer supply device comprising:

a container configured to receive and contain a developer from a toner cartridge, wherein the container has a supply port configured to supply the developer, which is contained in the container, to a developing device;

a first transporter that is rotatably disposed in the container, wherein the first transporter is configured to transport the developer at a first transport speed by rotating; and a second transporter that is rotatably disposed in the container, wherein the second transporter is configured to transport the developer at a second transport speed that is higher than the first transport speed by rotating, wherein the first transporter is configured to rotate about a first rotational axis, wherein the developer supply device is configured such that a line colinear with the first rotational axis passes through the second transporter, wherein the first transporter includes a wire rod wound in a substantially helical manner at a first helical pitch, wherein the second transporter includes a substantially helical blade arranged along an outer periphery of a shaft at a second helical pitch that is longer than the first helical pitch, wherein a blade height of the blade in a direction crossing the shaft is larger than a wire diameter of the wire rod, wherein a predetermined space is formed between the substantially helical blade and the shaft and that the developer is capable of passing through the space, wherein the developer supply device further comprises a sensor configured to detect the developer contained in the container, wherein the second transporter faces the sensor, and wherein the second transporter includes a cleaning member configured to clean a sensing surface of the sensor, to which an interior of the container is exposed, by passing across the sensing surface from a first end of the sensing surface to a second end of the sensing surface while being in contact with the sensing surface.

2. The developer supply device according to claim 1, wherein an end of the first transporter is fitted to an end of the shaft of the second transporter in such a manner that the first transporter is connected to the second transporter and is capable of integrally rotating with the second transporter, and wherein a phase of a helical structure of the first transporter and a phase of a helical structure of the second transporter substantially match each other at a connecting portion in which the first transporter and the second transporter are connected to each other.

3. The developer supply device according to claim 2, wherein an outer diameter of the first transporter and an outer diameter of the second transporter are approximately equal to each other.

4. The developer supply device according to claim 1, wherein the first transporter is formed of a metal coil, and wherein the second transporter is made of a synthetic resin.

5. An image forming apparatus comprising:

an image carrier that has a surface on which an electrostatic latent image can be formed;

a developing device configured to develop, with a developer that includes at least a toner, the electrostatic latent image on the image carrier;

a toner cartridge configured to contain the developer, which is used by the developing device; and the developer supply device according to claim 1 configured to supply the developer in the toner cartridge to the developing device.

6. An image forming apparatus comprising:

an image carrier that has a surface on which an electrostatic latent image can be formed;

a developing device configured to develop, with a developer that includes at least a toner, the electrostatic latent image on the image carrier;

a toner cartridge configured to contain the developer, which is used by the developing device; and the developer supply device according to claim 2 configured to supply the developer in the toner cartridge to the developing device.

7. An image forming apparatus comprising:

an image carrier that has a surface on which an electrostatic latent image can be formed;

a developing device configured to develop, with a developer that includes at least a toner, the electrostatic latent image on the image carrier;

a toner cartridge configured to contain the developer, which is used by the developing device; and the developer supply device according to claim 3 configured to supply the developer in the toner cartridge to the developing device.

8. A developer supply device comprising:

a container configured to receive and contain a developer from a toner cartridge, wherein the container has a supply port configured to supply the developer, which is contained in the container, to a developing device;

a first transporter that is rotatably disposed in the container, wherein the first transporter is configured to transport the developer at a first transport speed by rotating; and a second transporter that is rotatably disposed in the container, wherein the second transporter is configured to transport the developer at a second transport speed that is higher than the first transport speed by rotating, wherein the first transporter is configured to rotate about a first rotational axis, wherein the second transporter is configured to rotate about a second rotational axis, wherein the developer supply device is configured such that the first rotational axis is approximately colinear with the second rotational axis, wherein the first transporter includes a wire rod wound in a substantially helical manner at a first helical pitch, wherein the second transporter includes a substantially helical blade arranged along an outer periphery of a shaft at a second helical pitch that is longer than the first helical pitch, wherein a blade height of the blade in a direction crossing the shaft is larger than a wire diameter of the wire rod, wherein a predetermined space is formed between the substantially helical blade and the shaft and that the developer is capable of passing through the space, wherein the developer supply device further comprises a sensor configured to detect the developer contained in the container, wherein the second transporter faces the sensor, and wherein the second transporter includes a cleaning member configured to clean a sensing surface of the sensor, to which an interior of the container is exposed, by passing across the sensing surface from a first end of the sensing surface to a second end of the sensing surface while being in contact with the sensing surface.

9. The developer supply device according to claim 1, wherein an opening is formed at a peripheral end of the shaft, and wherein a peripheral end of the wire rod is fitted into the opening.

10. The developer supply device according to claim 1, wherein an outer diameter of the first transporter and an outer diameter of the second transporter are approximately equal to each other, and wherein the second transporter is configured to transport the developer at the second transport speed that is higher than the first transport speed by rotating at a same rotational speed as the first transporter.

11. The developer supply device according to claim 1, wherein the developer supply device is configured to be installed in an image forming apparatus, and wherein the developer supply device is configured such that replacement of the toner cartridge may be performed without stopping the image forming apparatus when the image forming apparatus is continuously performing a printing operation.

* * * * *